US005144921A

United States Patent [19]

Clos et al.

[11] Patent Number: 5,144,921

[45] Date of Patent: Sep. 8, 1992

[54] VALVE-CONTROLLED INTERNAL COMBUSTION ENGINE

[75] Inventors: Richard Clos, Oberstenfeld; Hannibal, Wilhelm, Neckarsulm; Fred Schäfer, Nachrodt; Norbert Südhaus, Neckarsulm, all of Fed. Rep. of Germany

[73] Assignee: Audi, A.G., Ingolstadt, Fed. Rep. of Germany

[21] Appl. No.: 790,569

[22] Filed: Nov. 12, 1991

[51] Int. Cl.[5] ..... F01L 1/34; F01M 1/06

[52] U.S. Cl. ..... 123/90.17; 123/90.31; 123/90.34

[58] Field of Search ..... 123/90.15, 90.17, 90.31, 123/90.33, 90.34; 464/2

[56] References Cited

U.S. PATENT DOCUMENTS

| | | | |
|---|---|---|---|
| 4,883,027 | 11/1989 | Oikawa et al. | 123/90.33 |
| 4,895,113 | 1/1990 | Speier et al. | 123/90.31 |
| 4,928,641 | 5/1990 | Niizato et al. | 123/90.33 |
| 4,942,855 | 7/1990 | Muto | 123/90.33 |
| 5,027,762 | 7/1991 | Tokuyama et al. | 123/90.34 |

FOREIGN PATENT DOCUMENTS

| | | | |
|---|---|---|---|
| 0305305 | 12/1990 | Japan | 123/90.17 |

*Primary Examiner*—E. Rollins Cross
*Assistant Examiner*—Weilun Lo
*Attorney, Agent, or Firm*—Kane, Dalsimer, Sullivan, Kurucz, Levy, Eisele and Richard

[57] ABSTRACT

A valve-controlled internal combustion engine has an device 13 for adjusting the camshaft 2 relative to its timing gear 14. The adjusting device has an operating sleeve, which is interlocked over different gear systems, on the one hand, with the timing gear and, on the other, with the camshaft, and a hydraulic adjusting piston, which can be acted upon on both sides. Pressure is caused to act upon the adjusting piston by means of the engine oil, which is circulating under pressure and which is branched off before a restrictor 11 in the inflow to the bearings 12 in the cylinder head 2 of the internal combustion engine. By these means, the full pressure of the lubricating pump 7 can be used to shift the operating sleeve.

3 Claims, 3 Drawing Sheets

VALVE-CONTROLLED INTERNAL COMBUSTION ENGINE

The invention relates to an internal combustion engine with variable valve control corresponding to the introductory portion of claim 1.

In a known internal combustion of this type (MTZ 50 (1989), 327-330), the oil under pressure that is required to shift the operating sleeve is derived from the oil, which is supplied under pressure to the cylinder head. This oil under pressure, which is supplied to lubricate the camshaft bearings and, if hydraulic cup tappets are present, has to ensure that these are constantly filled with oil, is only under a relatively low pressure, since, because of the numerous camshaft bearings, there would be much leakage at these bearings if the lubricating oil were under a high pressure. Such a leakage would made a large oil pump necessary and cause problems with respect to the carrying away of the large amounts of leaked oil. In the case of hydraulic cup tappets, an unwanted pumping up of the same is to be feared at high pressures. On the other, a high lubricating oil pressure is required to supply the crankshaft bearings adequately with lubricating oil. For this reason, the lubricating oil is supplied to the cylinder head from the lubricating oil pump over a throttle, which reduces the pressure in the lubricating oil supply system of the cylinder head to a permissible value. This relatively low pressure of, for example, 1 bar, compared with the pump pressure of about 4 to 5 bar, makes it necessary for the adjusting piston of the camshaft adjusting device to have a large piston surface for achieving the required adjusting force. As a result, the structural volume of the adjusting device has to be large. A large piston surface is associated with a correspondingly large filling space, which leads to relatively long adjusting times.

In order to counter this problem, it is known that the operating mechanism for the operating sleeve can be supplied by a hydraulic system, which is separate from the internal combustion engine. However, this entails appreciable, additional structural expenditures.

It is an object of the invention to provide an internal combustion engine of the generic type, the camshaft adjusting device of which requires little space and a short time for any adjustment and supplies oil under pressure with a system, which can be realized at the least possible expense for construction.

Pursuant to the invention, this objective is accomplished owing to the fact that the oil, which flows under pressure to the control element, is diverted downstream from the throttle from the pressure line of the lubricating oil pump.

In the case of the invention proposal therefore, the whole of the pressure of the lubricating oil pump is available for actuating the operating sleeve, without requiring a separate hydraulic system.

The embodiment of the invention is described in the following with reference to the drawings.

Figure 1:
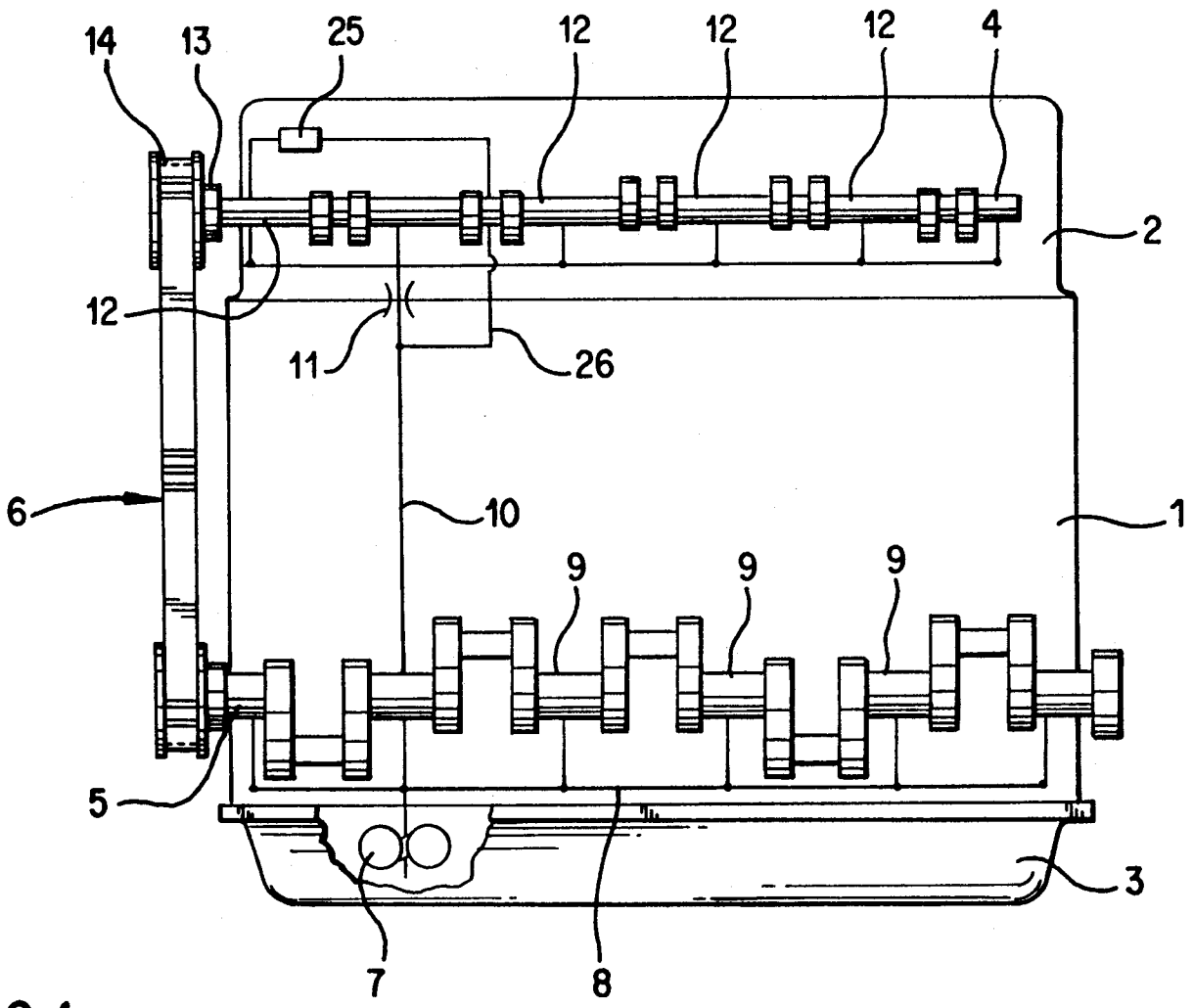
FIG. 1 shows a diagrammatic representation of an internal combustion engine with its lubricating system.

Reference is made first of all to FIG. 1, in which an internal combustion engine is shown diagrammatically, which has a cylinder crankcase 1, a cylinder head 2 and an oil pan 3. At least on camshaft 4, which is driven by the crankshaft 5 of the internal combustion engine by way of a flexible connection transmission 6, is mounted on bearings in the cylinder head 2. An oil pump 7 supplies lubricating oil to the various bearings of the internal combustion engine. This oil pump 7 takes in lubricating oil from the oil pan 3 and delivers it over a first delivery line 8 to the bearings 9 of the crankshaft and through a second delivery line 10 over a restrictor 11 in the cylinder head 2 to lubricate the camshaft bearings 12 and so supply the cup tappets, which are not shown.

Figure 2:
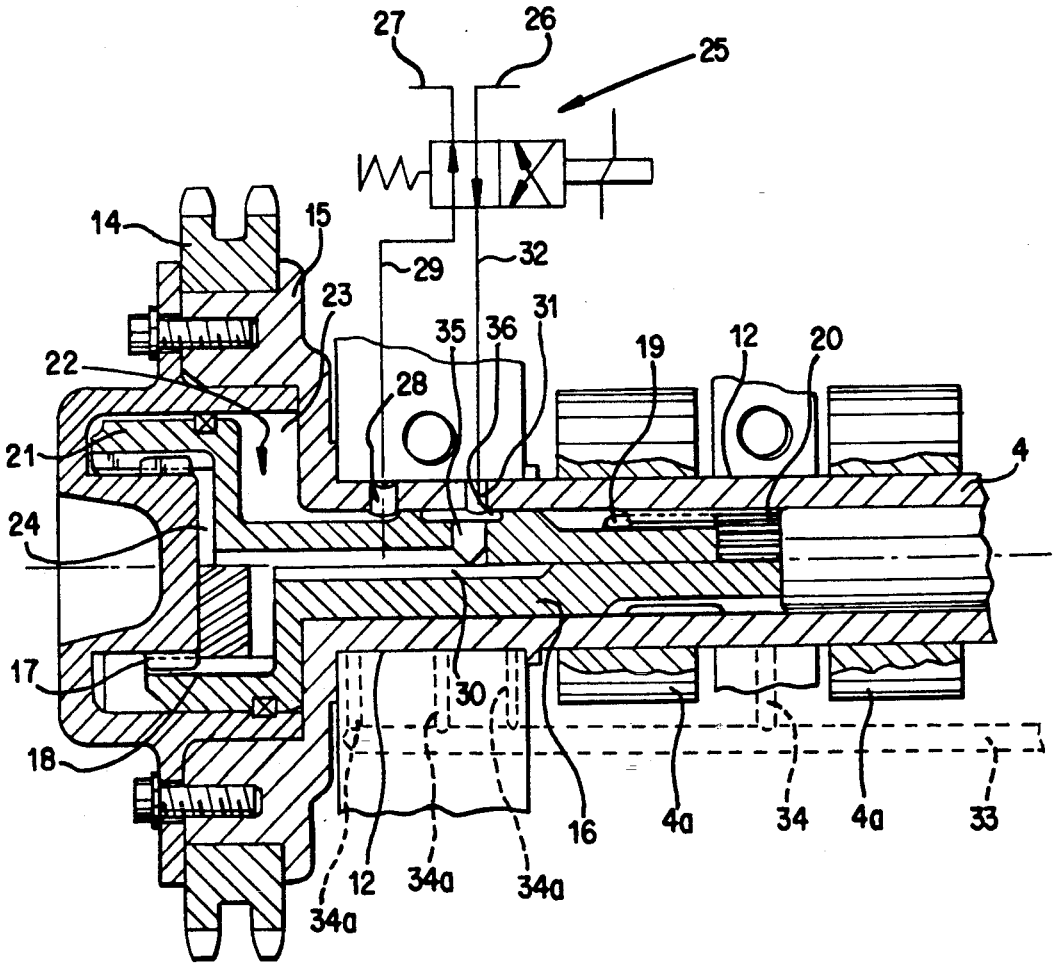
FIG. 2 shows a longitudinal section through the camshaft adjusting device.

A device 13, which is shown in detail in FIG. 2, serves to adjust the angle of the camshaft 4 relative to the timing gear 14, which is driven by the crankshaft 5 and is rotatably mounted on a continuation 15 of the camshaft 4. The adjusting device 13 has an operating sleeve 16, which is disposed coaxially with the camshaft 4, can be moved axially between two end positions and is shown in the upper half of FIG. 2 in the one end position and in the lower half of FIG. 2 in the other end position. A first gear system 17, 18, which is constructed as a spiral gear system, is provided between the operating sleeve 16 and the timing gear 14 and a second gear system 19, 20, which is constructed as a spur tooth system, is provided between the operating sleeve 16 and the camshaft 4. An interlocking connection between the timing gear 14 and the camshaft 4 is produced by the gear systems 17, 18 and 19, 20. Because of the spiral gear system 17, 18, a shifting of the operating sleeve 16 causes the camshaft 4 to be rotated relative to the timing gear 14. With that, the control times of the valves, which are operated by the cams **4*a* of the camshaft 4**, are changed.

The operating sleeve 16 is moved hydraulically. For this purpose, the operating sleeve 16 is constructed in one piece with an adjusting piston 21, which is disposed in a cylindrical space 22 within the timing gear 14 and divides this space into two pressure chambers 23 and 24, which can be connected by a reversing valve 25, depending on the operating parameters, either with an inflow duct 26 or an outflow duct 27 for the oil under pressure. The reversing valve 25 normally is integrated in the cylinder head and is shown as a separate component only for the sake of greater clarity. The connecting between the pressure chamber 23 and the reversing valve 25 is established over a radial borehole 28 in the camshaft 4 and a duct 29 in the cylinder head 1, which discharges into the bearing surface 12 of the camshaft 4. The connection between the pressure chamber 24 and the reversing valve 25 is established over a longitudinal borehole 30, a radial borehole 35 and a groove 36 in the operating sleeve 16, as well as by way of a second radial borehole 31 in the camshaft and a duct 32 in the cylinder head, which once again discharges in the bearing surface 12 of the camshaft 4. The position of the reversing valve 25 shown corresponds to the position of the operating sleeve 16 in the lower half of FIG. 2, in which the pressure chamber 24 is connected with the inflow duct 26 and the pressure chamber 23 is connected with the outflow duct 27.

As mentioned at the beginning in connection with FIG. 1, the bearings 12 of the camshaft 4 are supplied with lubricating oil over a restrictor 11. The lubrication oil duct 33 in question is drawn in FIG. 2 by a broken line. Branch ducts 34 to the individual bearings 12 start out from said lubricating oil duct 33. The inflow duct 26 for the oil under pressure for the adjusting device 13 is branched off ahead of the restrictor 11 from the feed line 10 of the lubricating oil pump 7. As a result, the full oil pressure of the lubricating oil pump 7 can be used for the adjusting device, with the result that the adjusting piston 21 can have a relatively small diameter and thus can readily be disposed within the timing gear 14. Due to the small capacity of the pressure chambers 23, 34, which has to be filled, and the high pressure, extremely short response times can be realized.

In order to ensure that sufficient lubricating oil is supplied to the bearing 12, by means of the bearing surface of which oil under pressure is supplied to the adjusting device over the whole width of the bearing, three branch ducts 34*a*, which discharge in the middle of and on either side of the outlets of the ducts 29, 32 into the bearing surface, are provided for this bearing.

Figure 3:
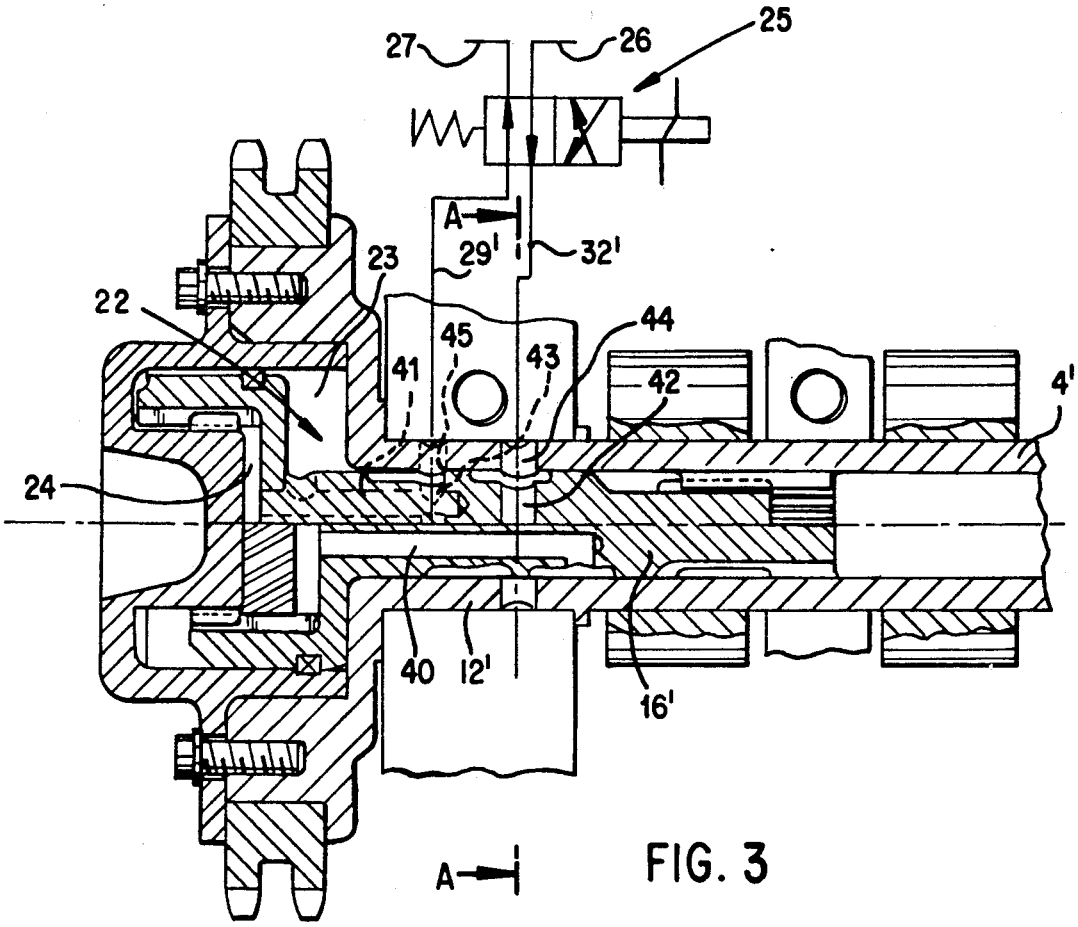
FIG. 3 shows a longitudinal section, similar to that of FIG. 2, but along line A—A of FIG. 4 with a modified system for supplying oil under pressure to the camshaft adjusting device.
Figure 4:
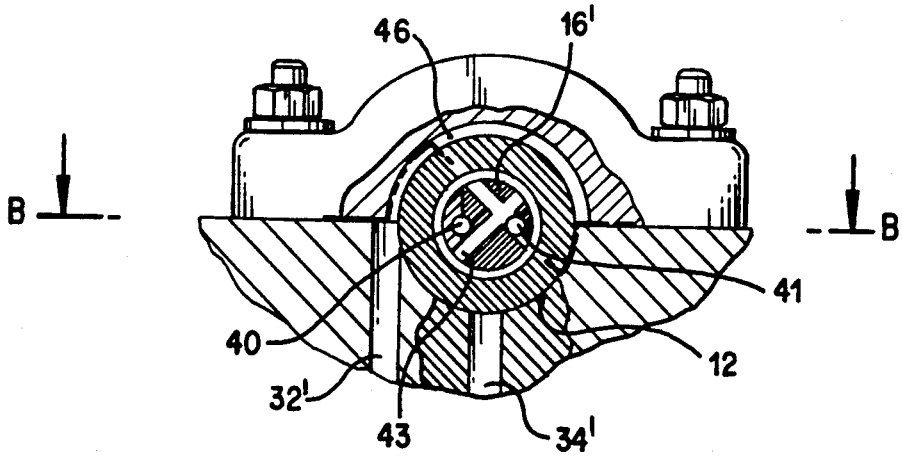
FIG. 4 shows a section along line B—B of FIG. 3.

A modified system for supplying oil under pressure to the pressure chambers 23 and 24 is shown in FIGS. 3 and 4. For this system, the oil under pressure is supplied through two parallel longitudinal boreholes 40 and 41 and radial boreholes 43, 43 in the operating sleeve 16', which, as in the embodiment of FIG. 2, is connected with radial boreholes 44, 45 in the camshaft 4', which, in turn, are connected through ducts 29', 32' with the revering valve 25. In order to ensure that the camshaft bearing 12' is supplied satisfactorily with lubricating oil through the branch duct 34', a semicircular groove 46, by means of which the oil under pressure is supplied by and returned to the pressure chambers, is provided in the bearing shell of the bearing 12' for each radial borehole 44, 45 in the less stressed region of the bearing. By these means, the lubricating oil can get from the branch duct 34' also into the region of the bearing, only half of which, however, is connected with the pressureless backflow duct 27, that is, in the region of the lower half of the bearing in FIG. 4.

The inventive proposal, to branch off the oil supplied under pressure to the adjusting device before the constrictor 11, can also be employed for an adjusting device, in which the adjusting piston is acted upon by oil under pressure on only one side, in order to bring about a shift of the operating sleeve in one direction, which the shift in the other direction is accomplished by means of the force of a spring. Such an adjusting device is known, for example from the DE-C 33 16 162.

We claim:

1. Valve-controlled internal combustion engine with a camshaft (4), which is supported on bearings in the cylinder head (2), and a device (13) for rotating the camshaft relative to a coaxial timing gear (14), said device (13) has an operating sleeve (16), which is disposed coaxially with the camshaft (4), can be shifted axially between two end positions, is interlocked by mean of a first gear system (17, 18) with the timing gear (14) and by means of a second gear system (19, 20) with the camshaft (4) and has a double-acting hydraulic adjusting piston (21), which is disposed in a cylindrical space (22) and divides this space into two separate pressure chambers (23, 24), which, depending on the position of a control element (25), can be connected either with an inflow line (26) or an outflow line (27) for the oil under pressure, lubricating oil being supplied to a camshaft bearing (12) by a lubricating oil pump (7) by way of a restrictor, characterized in that the inflow (26) of oil under pressure to the control element (250 is branched off upstream of the restrictor (11) in a pressure line (10) from the lubricating oil pump (7).

2. The internal combustion engine of claim 1, characterized in that the control element (25), which connects the inflow line (26) and the outflow line (27) for the oil under pressure with the pressure chambers (23, 24), is connected over ducts (29, 32) in the cylinder head with a bearing (12) of the camshaft (4), and that, between and on either side of the outlets of these ducts (29, 32)), are branch ducts (34*a*) for supplying lubricating oil to the bearing.

3. The internal combustion engine of claim 1, characterized in that the control element (25), which connects the inflow line (26) and the outflow line (27) for the oil under pressure with the pressure chambers (23, 24), is connected over ducts (29, 32) in the cylinder head with a bearing (12') of the camshaft (4'), and that these ducts discharge into semicircular grooves (46) in a less stressed region of the bearing surface and that a branch duct (34') for supplying lubricating oil to the bearing surface discharges between these semicircular grooves.

* * * * *